US008707517B2

(12) United States Patent
Hofer

(10) Patent No.: US 8,707,517 B2
(45) Date of Patent: Apr. 29, 2014

(54) HINGE FOR A FOLDING DOOR

(75) Inventor: Claus Hofer, Fussach (AT)

(73) Assignee: Julius Blum GmbH, Hoechst (AT)

( * ) Notice: Subject to any disclaimer, the term of this patent is extended or adjusted under 35 U.S.C. 154(b) by 1848 days.

(21) Appl. No.: 11/251,935

(22) Filed: Oct. 18, 2005

(65) Prior Publication Data

US 2006/0090295 A1 May 4, 2006

(30) Foreign Application Priority Data

Oct. 28, 2004 (AT) ..... A 1815/2004

(51) Int. Cl.
*E05D 7/04* (2006.01)

(52) U.S. Cl.
USPC ..... 16/242; 16/240; 16/245; 16/389

(58) Field of Classification Search
USPC ..... 16/242, 245, 240, 238, 235, 236, 246, 16/382, 368, 369
See application file for complete search history.

(56) References Cited

U.S. PATENT DOCUMENTS

| | | | | |
|---|---|---|---|---|
| 4,742,599 | A * | 5/1988 | Salice | 16/382 |
| 5,201,096 | A * | 4/1993 | Dubach et al. | 16/236 |
| 5,283,929 | A * | 2/1994 | Lin | 16/237 |
| 6,032,333 | A * | 3/2000 | Brustle | 16/242 |
| 6,233,783 | B1 * | 5/2001 | Dubach | 16/237 |
| 6,442,798 | B1 * | 9/2002 | Rupprechter | 16/242 |
| 6,880,205 | B2 * | 4/2005 | Rupprechter | 16/235 |
| 6,883,204 | B2 | 4/2005 | Salice | |
| 6,918,158 | B2 * | 7/2005 | Isele | 16/235 |
| 7,017,231 | B2 * | 3/2006 | Isele | 16/242 |
| 2004/0025293 | A1 | 2/2004 | Salice | |

FOREIGN PATENT DOCUMENTS

| | | |
|---|---|---|
| CN | 1205758 | 1/1999 |
| CN | 2406023 | 11/2000 |
| DE | 92 03 048.3 | 4/1992 |
| DE | 102 10 017 C1 | 7/2003 |
| EP | 0 463 439 A1 | 1/1992 |
| EP | 1 367 203 | 12/2003 |
| FR | 2 368 596 | 5/1978 |
| FR | 2 829 792 | 3/2003 |

OTHER PUBLICATIONS

European Search Report issued Apr. 22, 2008 in connection with the corresponding European patent application.

* cited by examiner

*Primary Examiner* — Chuck Mah
(74) *Attorney, Agent, or Firm* — Wenderoth, Lind & Ponack, L.L.P.

(57) ABSTRACT

A hinge for a folding door, in particular for movable furniture parts, has at least one abutment part with a first section for securing the hinge to a furniture part and a second section which is at an angle thereto and is adjustable in length. The adjustment in length of the second section is performed using a transmission device for converting a rotary movement into a longitudinal movement.

21 Claims, 6 Drawing Sheets

HINGE FOR A FOLDING DOOR

BACKGROUND INVENTION

The present invention relates to a hinge for a folding door, in particular for movable furniture parts. The hinge has at least one abutment part with a first region for securing the hinge to a furniture part or the like and a second region which is at an angle thereto and is adjustable in length.

Hinges for folding doors are used to connect in a pivotal manner two movable furniture parts which form, for example, the door in the region of a returning corner of a fitted kitchen or the like. For this reason, they are suitable for reaching around a reflex angle. So that a hinge for a folding door can be used for different panel thicknesses of the furniture parts, a tilted adjustment, as it is called, is already known. This is created in the case of the prior art in the second region of the abutment part, which is at an angle and is adjustable in length, as a combination of an elongated hole and a clamping screw. Fine teeth have to be provided in the elongated hole so that locking can be maintained with stability. To make an adjustment, first of all the clamping screw has to be loosened and then the adjustment performed, and thereafter the clamping screw has to be tightened again. This is very cumbersome. Moreover, as a rule, at least two hinges have to be adjusted in the same way at the same time, which because of the need to loosen the clamping screws results in an unstable intermediate condition. A further disadvantage consists in the fact that stepless variable adjustment is not possible because of the need for teeth in the elongated hole.

SUMMARY OF THE INVENTION

It is therefore the object of the invention to improve the above-described tilted adjustment for hinges for folding doors such that a stepless adjustment which is as simple as possible is made possible.

In accordance with the invention, this is achieved in that, for the purpose of adjustment in length in the second region, a transmission device for converting a rotary movement into a longitudinal movement is provided.

As a result of the transmission device for converting a rotary movement into a longitudinal movement, for the purpose of making a tilted adjustment it is no longer necessary to loosen a clamping screw and tighten it again. The hinge for a folding door and the furniture parts which are secured thereto remain in a stable position with respect to one another throughout the adjustment procedure. Moreover, the transmission device according to the invention also makes it possible to perform a stepless tilted adjustment. In this connection, it is particularly advantageous if the transmission device is self-locking (that is to say that it remains in any position, once adopted, without further measures). The transmission device is advantageously arranged directly in the second region of the abutment part, in which the adjustment in length is to be performed.

BRIEF DESCRIPTION OF THE DRAWINGS

Various embodiments and further advantages of the invention will be explained with reference to the attached figures, in which.

DETAILED DESCRIPTION OF THE INVENTION

Figure 1:
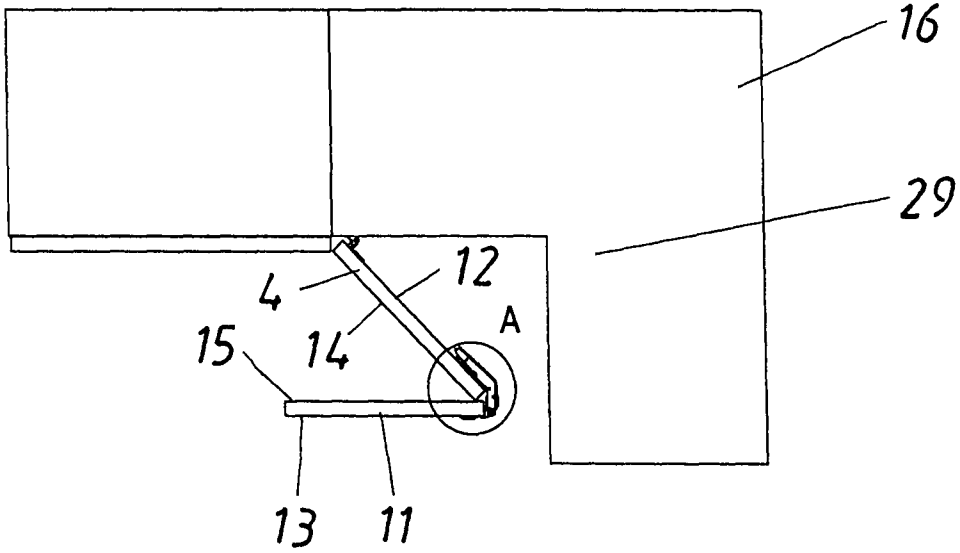
FIG. 1 is a schematic diagram showing a typical installation situation for a hinge for a folding door.
Figure 2:
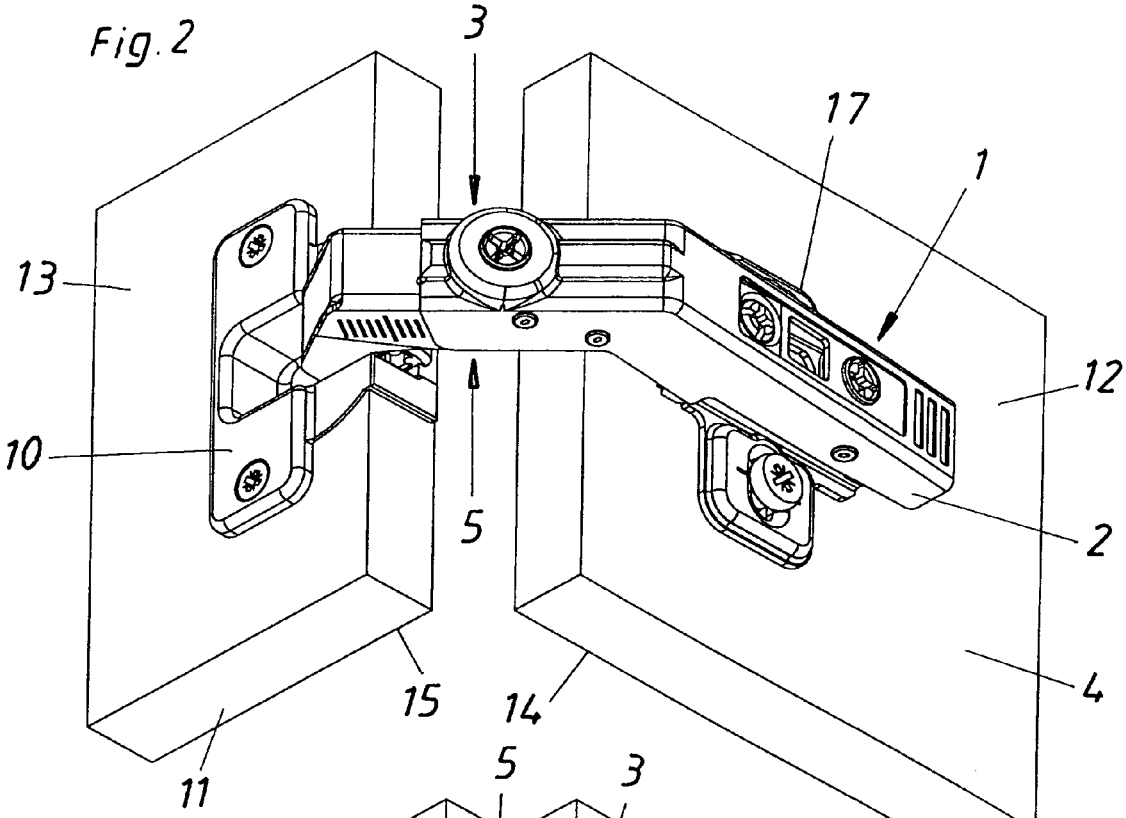
FIGS. 2 to 5 are various views showing a first example embodiment of the invention.
Figure 3:
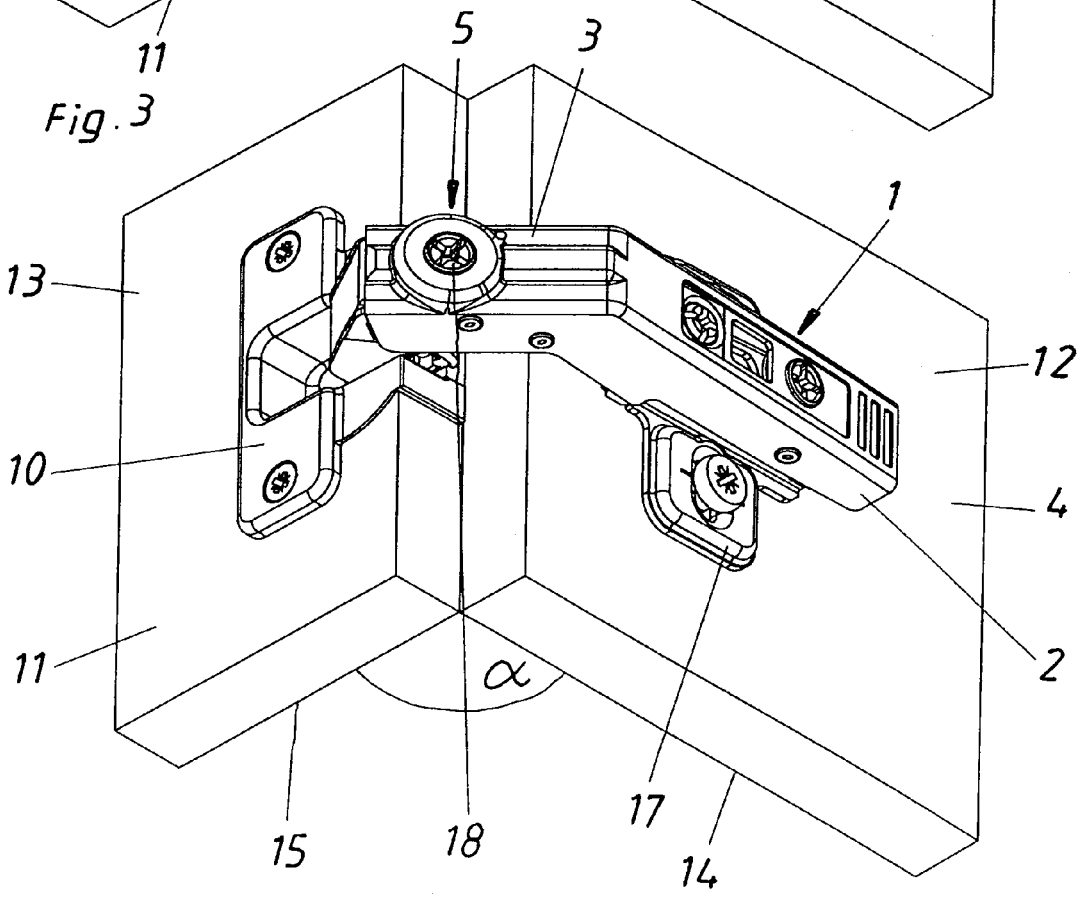

FIG. 1 shows a corner cabinet 16 in which the returning corner 29 may be closed off by the movable furniture parts 4 and 11. Between these two furniture parts there is arranged, for this purpose, a hinge for a folding door in the region A. This connects the two furniture parts 4 and 11 to one another such that, when the abutment parts 1 and 10 of the hinge for the folding door are mounted on the respective rear sides 12 and 13 of the furniture parts 4 and 11, the front sides 14 and 15 of the furniture parts 4 and 11, which are opposed to the rear sides 12 and 13, define an angle $\alpha$ of substantially 90° with one another in at least one end position, in this case the closed position. If the corner cabinets 16 or the like have a different shape, another angle smaller than 180° between the two front sides 14 and 15 may be defined. A comparison between FIGS. 2 and 3 shows the main function of the tilted adjustment. By means of the tilted adjustment, the spacing between the furniture parts 4 and 11 can be adjusted so that, for example, an adjustment to different panel thicknesses of the furniture parts becomes possible. FIG. 3 shows, although in a perspective illustration, the angle $\alpha$ between the fronts 14 and 15 of the furniture parts 4 and 11.

In this example embodiment, as in the others, a hinge arm 1 and a hinge cup 10 are provided as the abutment parts. The pivotal connection between the hinge arm and the hinge cup, or the abutment parts, may take the same form as that known from the prior art. The hinge arm 1 may be clipped onto a base plate 17, as in this example embodiment. These embodiments of the abutment parts should be seen only as examples, however. The essential point for a hinge for a folding door is that an abutment part—in this case the hinge arm 1—has a first region (section) 2 for securing the hinge to a furniture part 4, and a second region (section) 3 which is at an angle to the first region and which is in turn adjustable in length. The length adjustment of the region 3 is achieved through a transmission device 5 according to the invention, which converts a rotary movement into a longitudinal movement.

Figure 4:
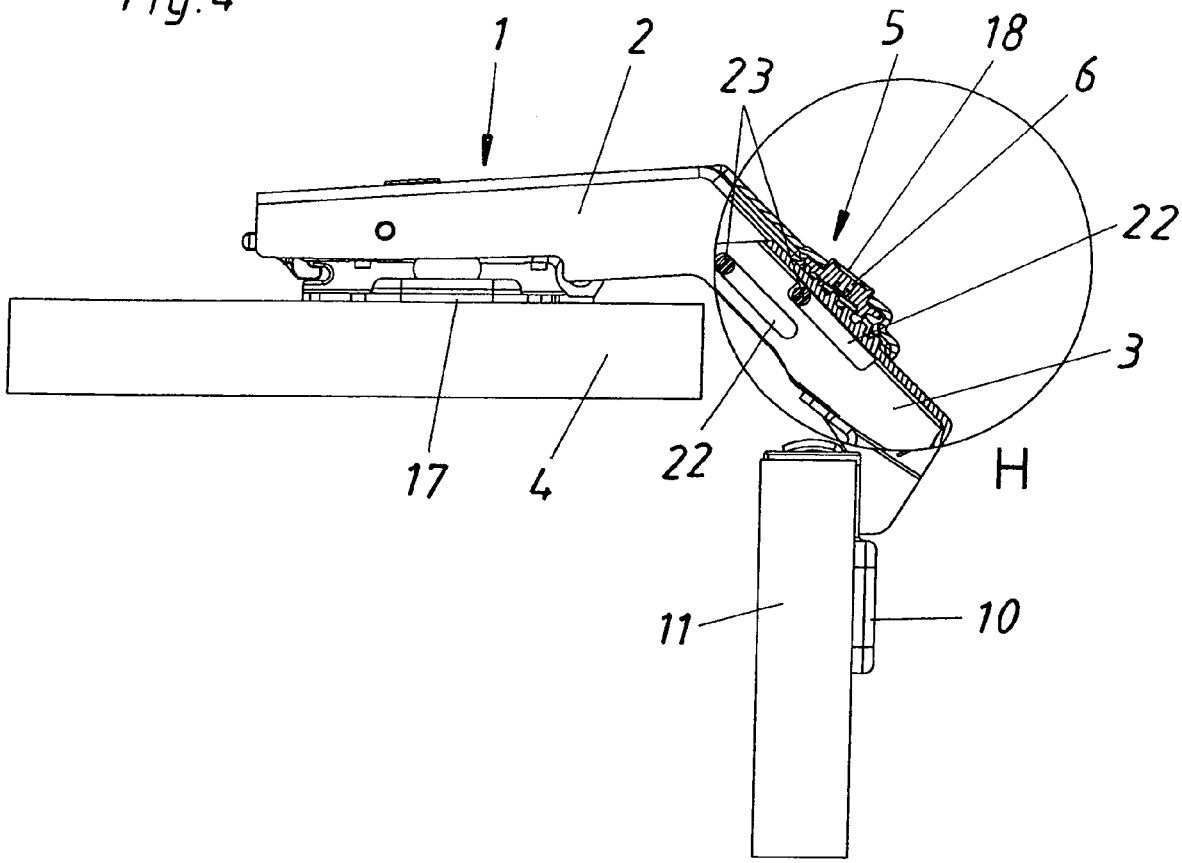
Figure 4A:
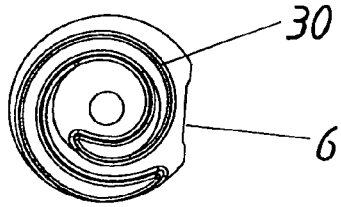
Figure 5:
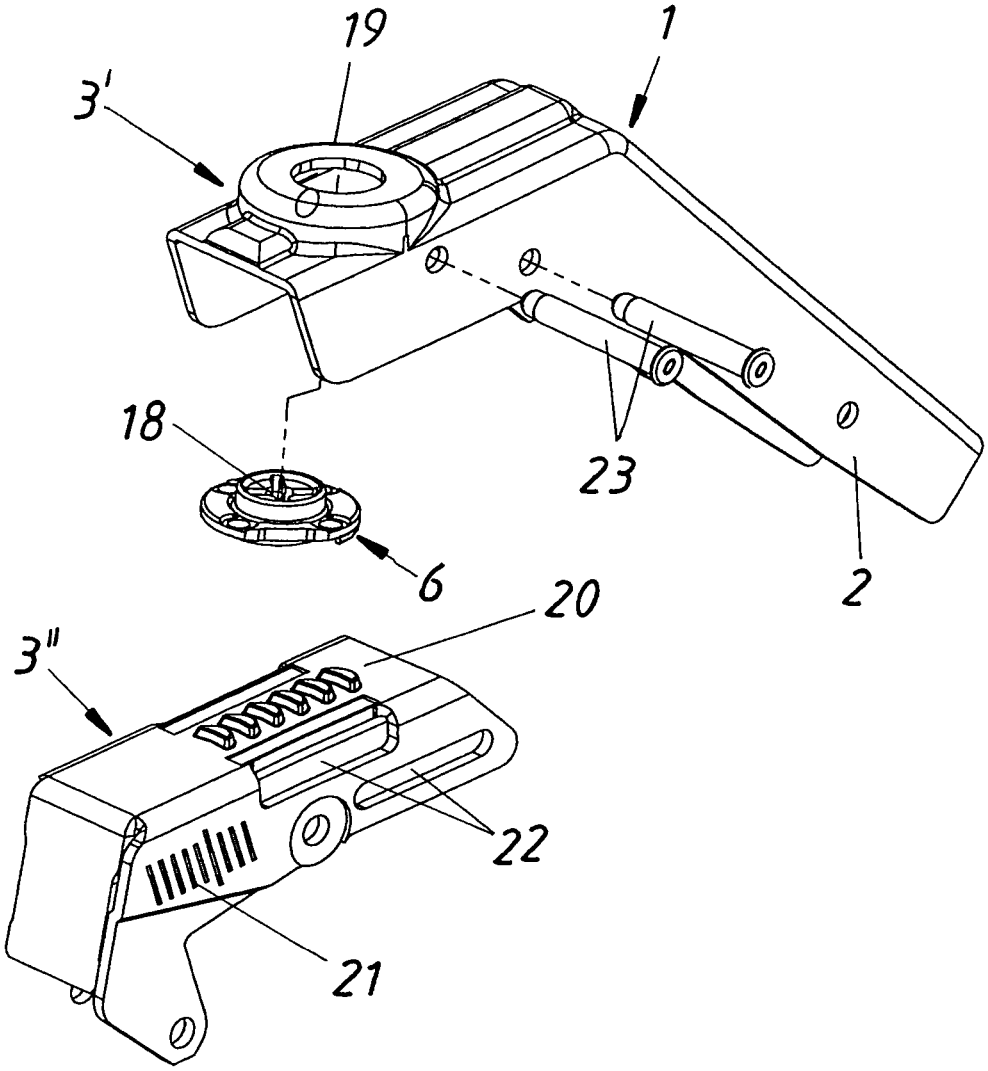

In the first example embodiment, in accordance with FIGS. 2 to 5, the transmission device 5 has as an essential component a spiral-shaped link piece 6. The second region 3 of the abutment part 1 is constructed in two pieces in the examples shown. It has two mutually displaceable, substantially U-shaped components 3' and 3". Two guide slits 22 in which the guide pins 23 of the first component 3' engage are arranged in the second component 3". In the arrangement in which mounting is complete, the two components 3' and 3" are thus mutually displaceable (can move relative to each other) along the guide slits 22, which is a prerequisite for the length adjustment in the region 3 of the abutment part 1. In order for the desired stepless and very easily performed adjustment in length to be made possible in accordance with the invention, in this example embodiment the spiral-shaped link piece 6, which is mounted in the guide housing 19 of the first component 3', engages the teeth 20 which are provided on the first component 3". The spiral-shaped link piece 6 is rotated with the aid of the slot 18, into which a screwdriver, for example, can be inserted. As a result of rotating the spiral-shaped link piece 6 engaging the teeth 20, the two components 3' and 3" are displaced relative to one another. Thus, adjustment in length or angular adjustment can be performed with precision. In addition, a marking 21 can be provided, for example on the second component 3". In FIG. 4, the region 3 is illustrated in partial section view as a detail H. FIG. 4*a* shows a view from below of the turns 30 of the spiral-shaped link piece, by means of which the spiral-shaped link piece 6 engages the teeth 20. It is possible to obtain a self-locking construction (i.e., no further components or processes necessary to lock the components 3', 3" to each other) of this example embodiment as a result of a correspondingly narrow seating of the two components 3' and 3" on one another in conjunction with the spiral-shaped link piece 6. The angle made between the first region 2 and the second region 3 of the abutment part 1 is substantially 45° in this case. However, other angles, for example between 40° and 50°, may also be provided.

Figure 6:
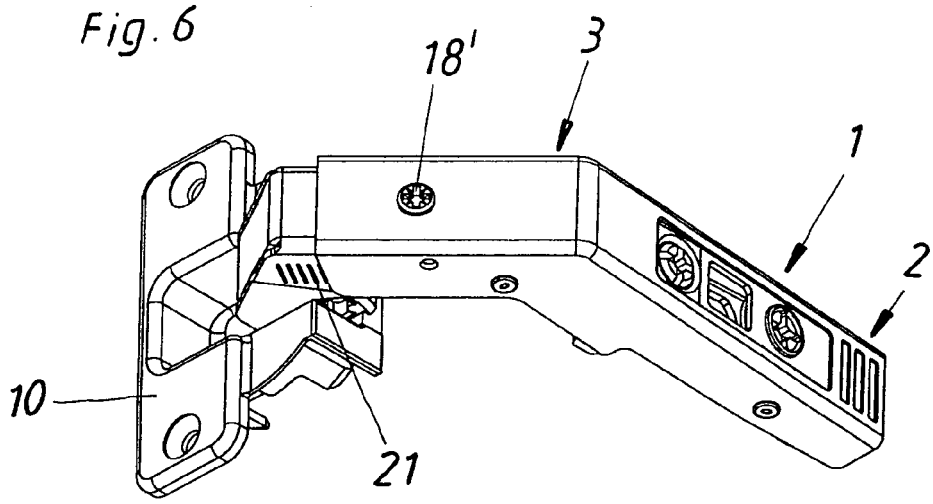
FIGS. 6 and 7 are various views showing a second example embodiment of the invention.
Figure 7:
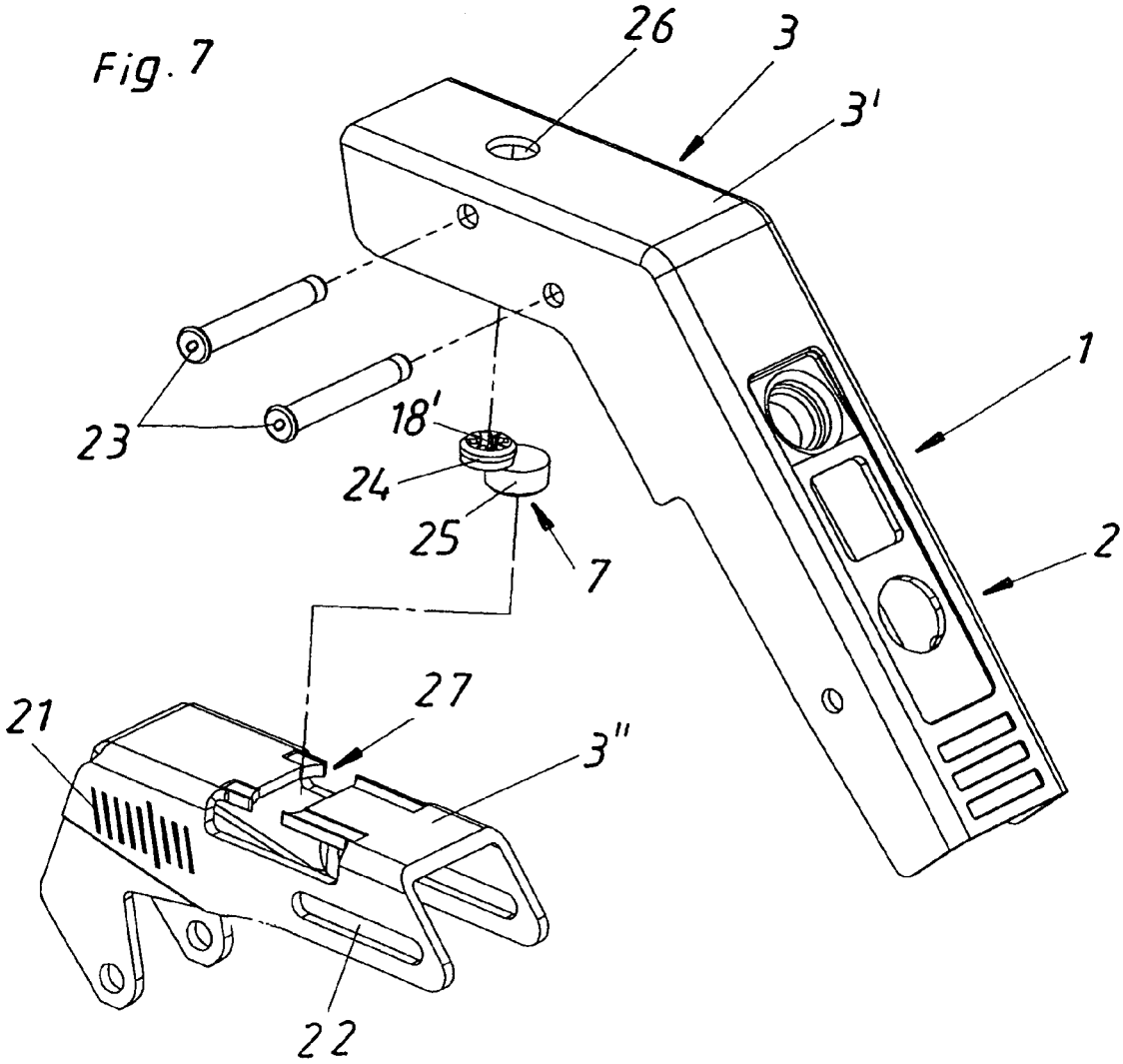

FIGS. 6 and 7 show an alternative embodiment of the transmission device 5 having the spiral-shaped link piece 6. In this case, the transmission device 5 has as an essential component an eccentric 7. The two components 3' and 3" are guided in one another in the same way as that described for the first example embodiment. The eccentric 7 has a first cylindrical portion 24 and a second cylindrical portion 25 which are secured to one another fixedly or rigidly. The first cylindrical portion 24 is seated rotatably in the hole 26 in the first component 3'. Actuation can be performed by means of a screwdriver, and so slots 18' are provided. It goes without saying that—as in the other example embodiments—corresponding receivers for hexagonal socket keys or a different tool may be arranged in the first portion 24, as an alternative. The second cylindrical portion 25 of the eccentric 7 is guided in the recess 27 in the second component 3". As a result of rotating the first cylindrical portion 24, the second portion 25, which is rigidly connected thereto, is rotated in the recess 27, which results overall in a relative displacement of the components 3' and 3" along the guide slits 22 and hence in an adjustment of the length of the second section 3 of the abutment part 1.

Figure 8:
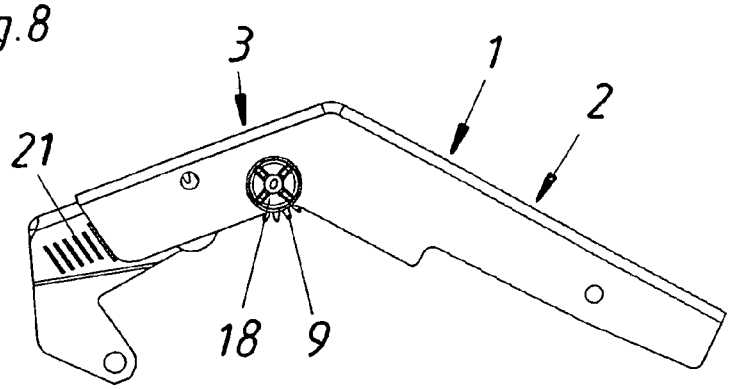
FIGS. 8 to 10 are various detail views showing the parts which are essential to the invention, in a third example embodiment of the invention.
Figure 9:
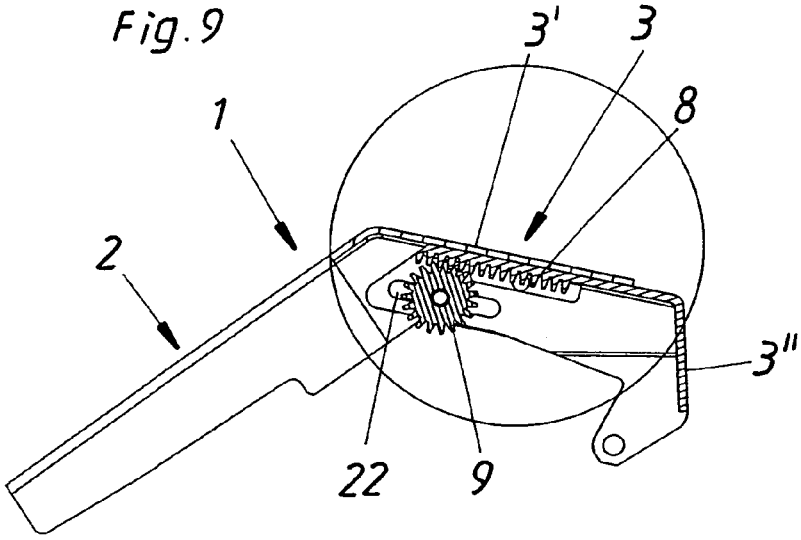
Figure 10:
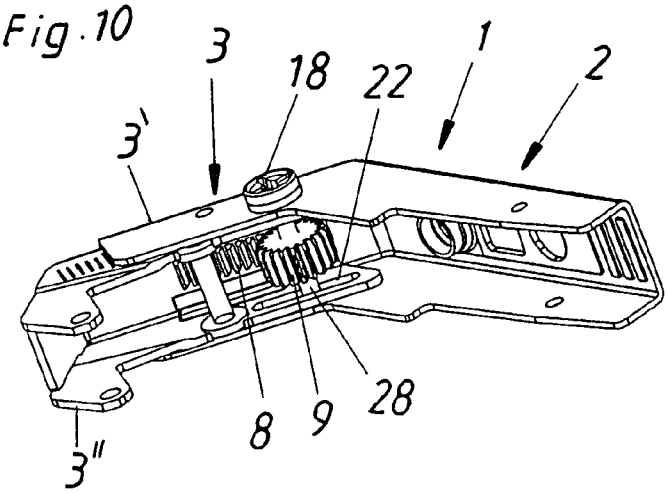

FIGS. 8 to 10 show an abutment part of a further hinge according to the invention. The other components of the hinge have been omitted from the illustration but may be constructed in the same way as in the other example embodiments. In this example embodiment, the adjustment in length is possible using a toothed wheel (pinion) 9 which engages a toothed rack 8. The toothed wheel 9 is arranged in the interior of the components 3' and 3", which have a U-shaped profile, and is fixed in its position relative to the outer first component 3' by the shaft 28. The teeth 8 are arranged on the second component 3". When the toothed wheel 9 is rotated, because it engages the toothed rack 8, the two components 3' and 3" are displaced relative to one another and hence there is an adjustment in length in the section 3. In order for the toothed wheel 9 to be rotated, once again, as in the other example embodiments, a slotted head 18 may be provided into which a screwdriver may be inserted. The slotted head 18, like the toothed wheel 9, is for this purpose arranged on a common shaft 28. The shaft 28 at the same time serves as a guide pin in the guide slit 22.

All the example embodiments are advantageously constructed to be self-locking, as a result of a correspondingly narrow seating of the components 3' and 3" on one another and the associated friction. Thus, the length of the second section 3, once it has been adjusted by means of the transmission device 5 for which is capable of converting a rotary movement into a longitudinal movement, is maintained unchanged until the next adjustment is made deliberately. Should particularly large ranges of adjustment in length be desired, the embodiments in accordance with the invention which have a spiral-shaped link track 6 or a toothed wheel 9 that engages in a toothed rack 8 are particularly suitable.

What is claimed is:

1. A hinge for a folding door, comprising:

a first abutment part to be attached to a first furniture part;

a second abutment part having a first section to be attached to a second furniture part, and having a second section extending from said first section at an angle relative to said first section, said second section including a first component and a second component linearly movable relative to said first component so as to adjust a length of said second section, said second section being pivotally connected to said first abutment part; and a self-locking transmission device on said second section of said second abutment part, said transmission device having a rotatable member and being operable to adjust the length of said second section by converting a rotation of said rotatable member into a longitudinal movement of said second component of said second section of said second abutment part relative to said first component of said second section;

wherein said second component of said second section has a pair of guide slits arranged on opposite sides of said second component and each extending in a longitudinal direction of said second component, and said first component has outwardly-projecting guide pins received within said guide slits so as to move through said guide slits as said second component moves linearly relative to said first component.

2. The hinge of claim 1, wherein said rotatable member of said transmission device comprises a spiral-shaped link piece.

3. The hinge of claim 2, wherein said second component of said second section has a set of teeth formed on a surface thereof for engaging a spiral-shaped projection on said link piece, said link piece being arranged on said first component of said second section.

4. The hinge of claim 1, wherein said rotatable member of said transmission device comprises an eccentric.

5. The hinge of claim 4, wherein said second component of said second section has a recess formed therein for engaging a cylindrical portion of said eccentric.

6. The hinge of claim 1, wherein said rotatable member of said transmission device comprises a toothed wheel.

7. The hinge of claim 6, wherein said second component of said second section has a toothed rack formed thereon for engaging said toothed wheel.

8. The hinge of claim 1, wherein said second section extends from said first section at an angle in a range of between 40° and 50° with respect to said first section.

9. The hinge of claim 1, wherein said second section extends from said first section at an angle of substantially 45° with respect to said first section.

10. The hinge of claim 1, wherein said second abutment part is pivotally connected to said first abutment part such that said hinge is operable to be positioned so that, when said first abutment part and said second abutment part are attached to a rear side of the first furniture part and the second furniture part, respectively, a front side of the first furniture part forms an angle smaller than 180° with respect to a front side of the second furniture part.

11. The hinge of claim 1, wherein said second abutment part is pivotally connected to said first abutment part such that said hinge is operable to be positioned so that, when said first abutment part and said second abutment part are attached to a rear side of the first furniture part and the second furniture part, respectively, a front side of the first furniture part forms an angle of substantially 90° with respect to a front side of the second furniture part.

12. The hinge of claim 1, wherein said first abutment part comprises a hinge cup and said second abutment part comprises a hinge arm.

13. The hinge of claim 1, wherein said first abutment part is to be attached to the first furniture part, and said second abutment part is to be attached to the second furniture part such that the first furniture part is to be movable relative to the second furniture part.

14. The hinge of claim 1, wherein said second abutment part comprises a hinge arm having said first section and said second section, said first component being fixed to said first section, said second component being operable to slide along said first component so as to increase and shorten a length of said hinge arm, said second component of said second section being pivotally connected to said first abutment part.

15. The hinge of claim 14, wherein said rotatable member of said transmission device is rotatably mounted to said first component of said second section, said second component having a catch element engaging said rotatable member such that a rotation of said rotatable member is converted to longitudinal sliding movement of said second component via said engagement of said rotatable member with said catch element.

16. The hinge of claim 15, wherein said rotatable member comprises a spiral-shaped link piece.

17. The hinge of claim 16, wherein said catch element comprises a set of teeth formed on a surface of said second component for engaging a spiral-shaped projection on said link piece.

18. The hinge of claim 15, wherein said rotatable member comprises an eccentric.

19. The hinge of claim 18, wherein said catch element comprises a recess formed in said second component for engaging a cylindrical portion of said eccentric.

20. The hinge of claim 15, wherein said rotatable member comprises a toothed wheel.

21. The hinge of claim 20, wherein said catch element comprises a toothed rack formed on a surface of said second component for engaging said toothed wheel.

* * * * *